United States Patent [19]

Makino

[11] Patent Number: 4,606,310

[45] Date of Patent: Aug. 19, 1986

[54] CRANKCASE FOR MULTI-CYLINDER ENGINE

[75] Inventor: Sakae Makino, Hamakita, Japan

[73] Assignee: Yamaha Hatsudoki Kabushiki Kaisha, Iwata, Japan

[21] Appl. No.: 654,651

[22] Filed: Sep. 25, 1984

[30] Foreign Application Priority Data

Sep. 26, 1983 [JP] Japan ..... 58-177568

[51] Int. Cl.[4] ..... F02B 75/06

[52] U.S. Cl. ..... 123/192 B; 123/195 C; 74/606 R

[58] Field of Search ..... 123/192 B, 192 R, 195 R, 123/195 C; 74/606 R

[56] References Cited

U.S. PATENT DOCUMENTS

| | | | |
|---|---|---|---|
| 3,563,223 | 2/1971 | Ishida | 123/192 B |
| 4,427,088 | 1/1984 | Tsuboi | 74/606 R |
| 4,463,823 | 8/1984 | Tsuboi | 74/606 R |
| 4,470,379 | 9/1984 | Miyakoshi et al. | 123/195 R |
| 4,509,378 | 4/1985 | Brown | 123/192 B |

FOREIGN PATENT DOCUMENTS

| | | | |
|---|---|---|---|
| 2913076 | 10/1979 | Fed. Rep. of Germany | 123/195 R |
| 54-163455 | 11/1979 | Japan . | |
| 72630 | 5/1980 | Japan | 123/195 R |
| 131322 | 8/1983 | Japan | 123/195 R |
| 15632 | 1/1984 | Japan | 123/195 R |

OTHER PUBLICATIONS

Das Motorrad, Apr. 21, 1973, p. 44.
Solo Moto, 1977, p. 43.
Cycle World, Mar. 1983, The Honda Motorcycle.

*Primary Examiner*—Magdalen Y. C. Greenlief
*Attorney, Agent, or Firm*—Ernest A. Beutler

[57] ABSTRACT

An improved engine and transmission casing assembly for a motorcycle that is made up of three major components. A first casing forms the engine and a portion of the crankcase for the engine. A second casing mates with the first casing and with it rotatably journals a pair of parallel crankshafts and further defines a transmission casing. The transmission casing is defined by a cavity that contains primary and secondary shafts and interengaging gears and which opens through one face of the second casing for insertion of the gears and shafts through this opening. This opening is closed by a cover plate which in part journals the transmission shafts.

14 Claims, 5 Drawing Figures

CRANKCASE FOR MULTI-CYLINDER ENGINE

BACKGROUND OF THE INVENTION

This invention relates to a crankcase for multi-cylinder engines and more particularly to an improved engine transmission assembly for such engines.

In many types of vehicle assemblies, the engine and transmission are constructed as a unitary assembly and many of their casings serve functions in both the engine and transmission. For example, it is typically common in motorcycle construction to employ a crankcase assembly for the engine that also serves as a transmission case. Such arrangements have the advantage of being compact and offering cost reductions. However, where such casings are fitted together and serve a variety of functions, it is desirable to reduce the number of mating faces so as to minimize the likelihood of leakage and also so as to reduce costs. However, somewhat inconsistent with this desire is the necessity to provide a construction that permits ease of assembly and disassembly for servicing.

It is, therefore, a principal object of this invention to provide an improved crankcase assembly for a multi-cylinder engine that also functions as a transmission case.

It is another object of this invention to provide an improved, simplified engine, transmission assembly that minimizes the number of components and which facilitates assembly and servicing.

SUMMARY OF THE INVENTION

This invention is adapted to be embodied in a combined engine transmission case comprising a first casing forming a portion of the engine, and a second casing forming a transmission case and fixed relative to the first casing. An engine output shaft is journaled at the interface between the first and second casings for rotation about a first axis. The second casing is formed with an internal cavity and an opening in one side thereof facing in a direction parallel to the first axis. A transmission shaft is insertable into the internal cavity of the second casing through its opening. Means are provided for driving the transmission shaft from the engine output shaft. A cover plate closes the second casing opening and at least in part journals the transmission shaft for rotation about a second axis that is parallel to the first axis.

DETAILED DESCRIPTION OF THE PREFERRED EMBODIMENT

Figure 1:
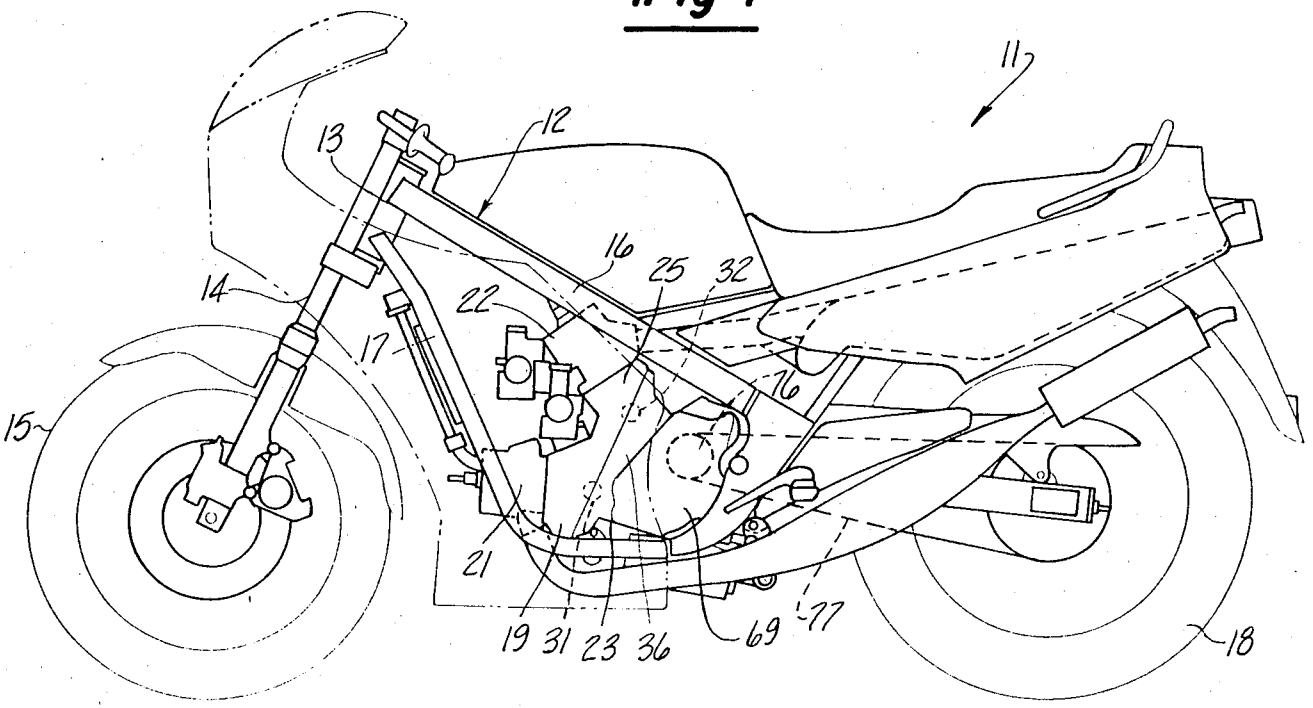
FIG. 1 is a side elevational view of a motorcycle having an engine transmission assembly constructed in accordance with an embodiment of the invention and with portions of the motorcycle shown in phantom.
Figure 2:
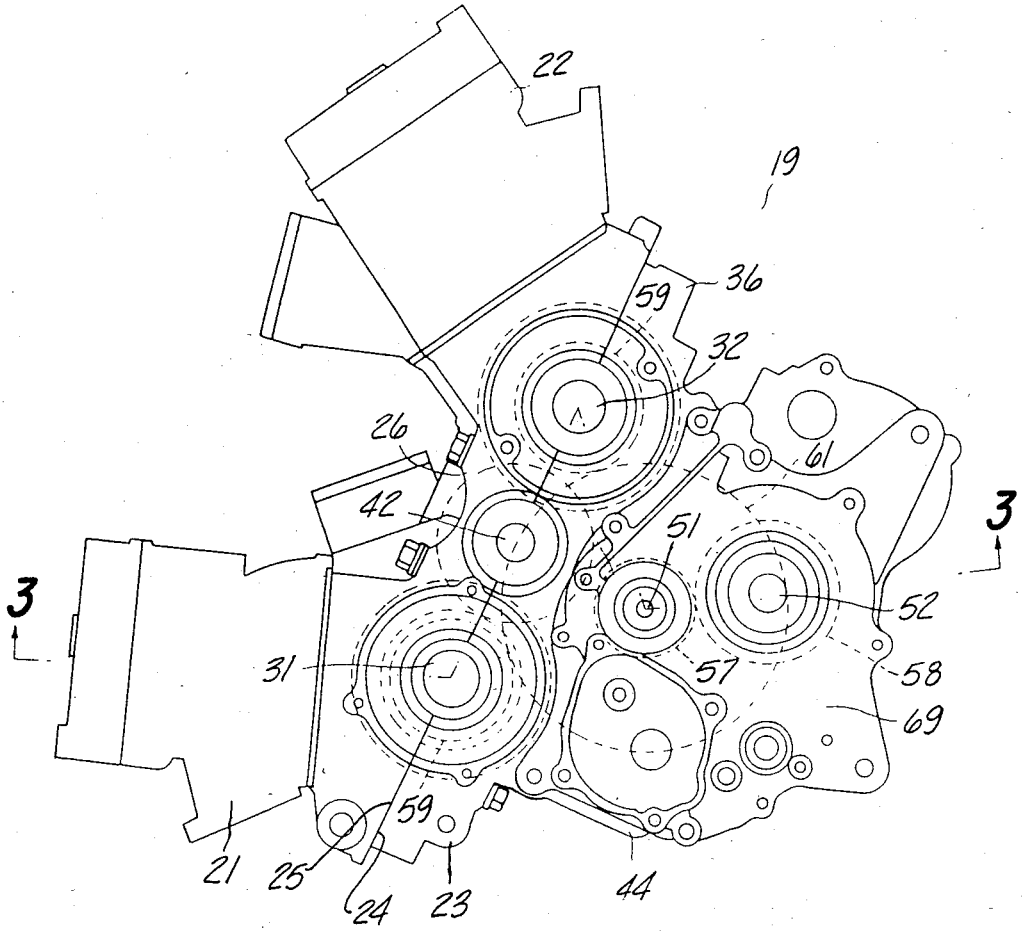
FIG. 2 is an enlarged, side elevational view of the engine and transmission assembly looking in the same direction as FIG. 1.
Figure 3:
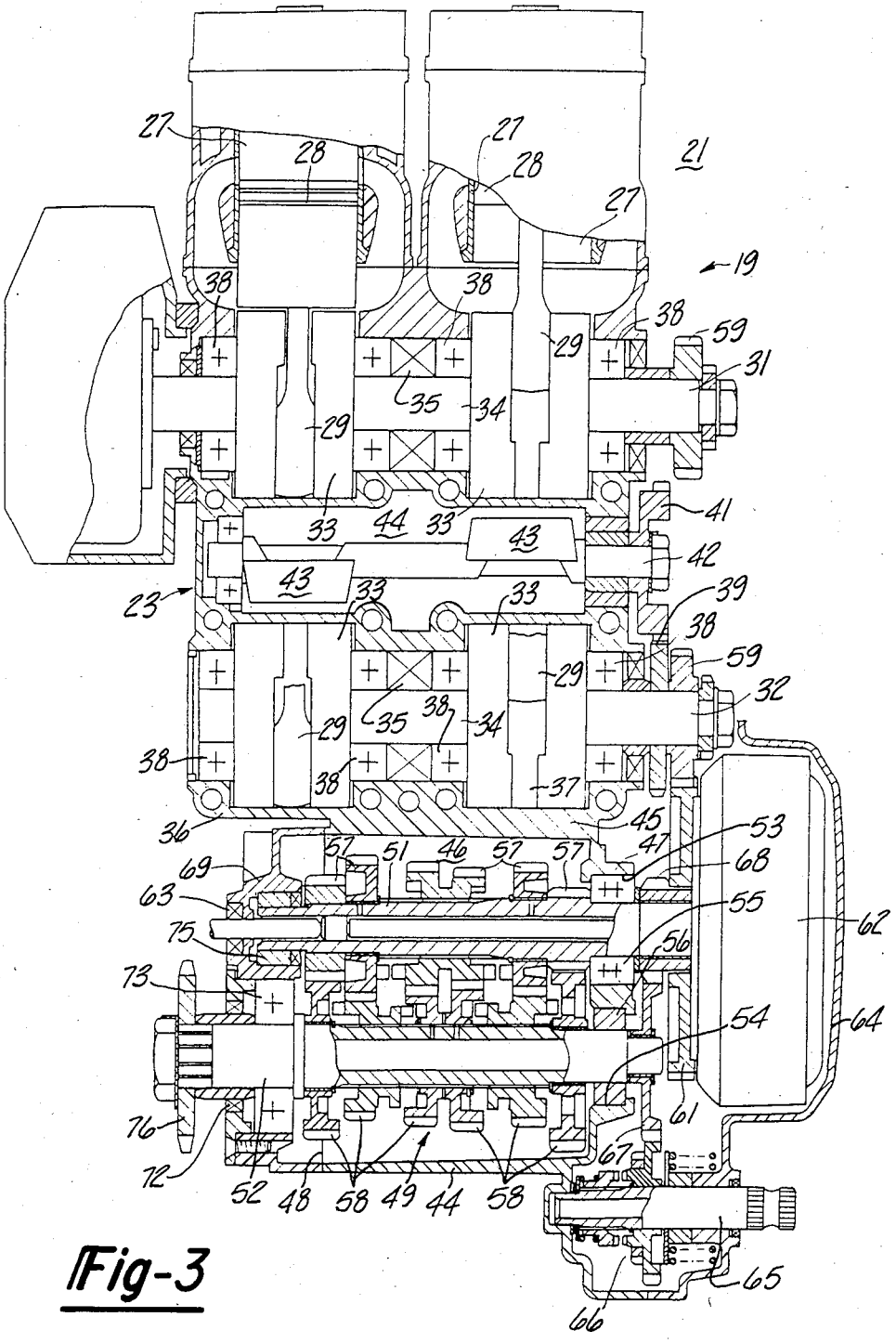
FIG. 3 is a cross-sectional view taken along the line 3—3 of FIG. 2.
Figure 4:
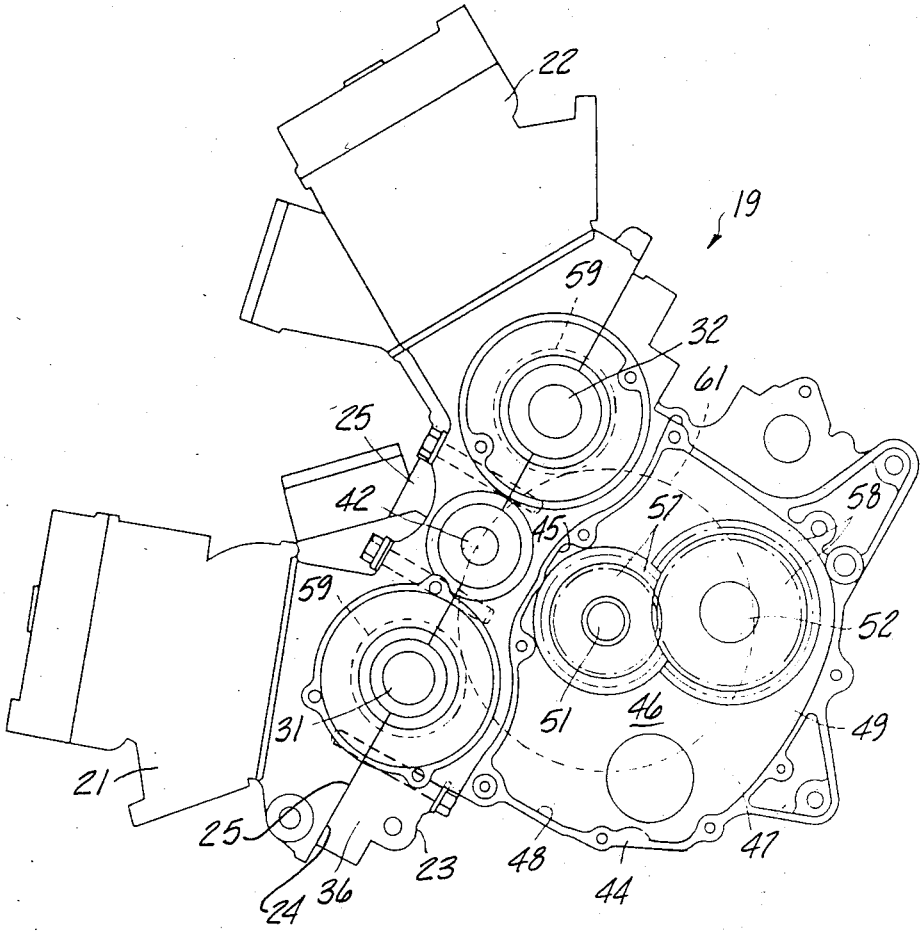
FIG. 4 is a side elevational view, in part similar to FIG. 2, with the cover plate removed.

Referring first to FIG. 1, a motorcycle constructed in accordance with an embodiment of the invention is identified generally by the reference numeral 11. The motorcycle 11 includes a frame assembly, which may be made from welded up frame of any suitable configuration and which is identified generally by the reference numeral 12. The frame asembly 12 includes a head tube 13 that supports a front fork assembly 14 for steering movement in a suitable manner. A front wheel 15 is carried by the front fork assembly 14 in a known manner.

A pair of tank tubes 16 are fixed, as by welding, at their forward ends to the head tube 13 and extend downwardly and rearwardly. In addition, the frame 12 includes a pair of down tubes 17 that are also affixed, as by welding, to the head tube 13 and which extend downwardly and then rearwardly where they are connected to the tank tubes 16 in a suitable manner. A rear wheel 18 is rotatably journaled by the frame assembly 12 and, if desired, may be suspended for suspension movement relative to it in a suitable way, as by means of a trailing arm suspension. The construction of the motorcycle 11 as thus far described forms no part of the invention and, for that reason, detailed description of the specific construction has not been made.

Rather, the invention relates to the construction of an engine transmission assembly, indicated generally by the reference numeral 19 and shown in most detail in the remaining figures. The engine transmission assembly 19 is supported in a suitable manner by the frame assembly 12 and drives the rear wheel 18 in a manner which will be described.

Referring now additionally to the remaining figures, the engine transmission assembly 19 includes an engine that operates on the two-stroke crankcase compression principle. In the illustrated embodiment, the engine is of the V4 type and includes a first casing comprising a cylinder block having a front or lower bank 21 and a rear or upper bank 22. The cylinder block casing consisting of the banks 21 and 22 is affixed to a combined crankcase transmission casing 23 in an appropriate manner with mating faces of the two casings indicated by the lines 24 and 25, respectively.

The cylinder banks 21 and 22 are disposed at a V angle relative to each other and are connected integrally at their lower ends by a valley portion 26. In the embodiment illustrated, the engine transmission assembly 19 is supported within the frame assembly 12 so that the cylinder bank 21 extends in a generally horizontal direction while the cylinder bank 22 is more vertically disposed although it is tilted forwardly from the vertical. This placement permits a compact arrangement and yet affords easy servicing of the engine components.

As has been noted, the engine of the engine transmission assembly 19 is of the V4 type. To this end, each cylinder bank 21 and 22 is provided with a respective pair of respective cylinder bores 27 that are aligned with each other in the respective bank. The cylinder bores 27 reciprocally support pistons 28 that are connected by means of connecting rods 29 to a crankshaft. In accordance with the illustrated embodiment of the invention, there is a first crankshaft 31 associated with the cylinder bank 21 and a second crankshaft 32 associated with the cylinder bank 22. That is, the pistons 28 of the cylinder bank 21 drive the crankshaft 31 while the pistons of the other cylinder bank 22 drive the crankshaft 32. By employing separate crankshafts for each cylinder bank 21 and 22, it is possible to have the throws 33 of the crankshafts to which the connecting rods 29 are affixed aligned with the respective throws of the other crankshaft. That is, with this arrangement, it is not necessary to stager the cylinders of the bank 21 and 22 relative to each other and thus a narrow engine configuration results.

Each crankshaft 31 and 32 is provided with a central main bearing portion 34 that is journaled by a bearing assembly 35 that is positioned between the cylinder block and specifically its V or valley section 26 and the transmission casing 23 at their respective mating faces 24 and 25 so as to journal the crankshafts 31 and 32 for rotation about parallel axes that lie within the plane of the faces 24 and 25.

The crankcase trnsmission casing 23 is provided with a crankcase portion 36 that defines individual crank chambers 37 that contain the respective throws 33 of the respective crankshafts 31 and 32. These crank chambers 37 are sealed from each other by means of suitable seals 38 carried between the cylinder block assembly and the crankcase transmission casing 23 so as to afford separately sealed crankcase chambers. A fuel/air mixture is introduced in each of the chambers 37 through a suitable induction system including appropriate charger formers for transfer to the combustion chambers through transfer passages in a known manner. This fuel/air charge is then fired by a spark plug so as to operate the engine and drive the crankshafts 31 and 32 in a known manner.

The crankshafts 31 and 32 protrude through the rear or righthand face of the engine transmission assembly 19 and have drive gears 39 affixed thereto which mesh with a driven gear 41 carried by an exposed rear end 42 of a balancer shaft. The balancer shaft 42 carries a pair of eccentric masses 43 disposed within a balancer cavity 44 defined between the cylinder block casing and the transmission crankcase casing 23. The balancer shaft 42 and specifically its balance weights 43 are intended to balance the reciprocating masses of the respective crankshafts 31 and 32 and the pistons and connecting rods 28, 29 associated therewith so that the engine will be balanced.

As has been noted, the casing 23, in addition to providing a portion of the crankcase by its crankcase portion 36 also provides a transmission portion, indicated by the reference numeral 44. The transmission portion 44 is connected to the crankcase portion 36 by an integral interconnecting wall 45. The transmission casing 44 is provided with a large internal cavity 46 that is closed at one end by an integral wall 47. The opposite end of the cavity 45 is exposed through a large opening 48 that extends through the opposite wall of the casing 23.

A change speed transmission, indicated generally by the reference numeral 49 is contained within the cavity 46. This change speed transmission 49 is comprises of a primary shaft 51 and a second shaft 52. The shafts 51 and 52 are supported for rotation about parallel axes, in a manner to be described, which axes are also parallel to the axes of rotation of the crankshafts 31 and 32 and the balancer shaft 42 and which extend transversely to the frame assembly 12 of the motorcycle 11.

The rear face 47 of the transmission casing 44 is provided with a pair of counterbored openings 53 and 54. The opening 53 receives an anti-friction bearing 55 that rotatably journals one end of the primary shaft 56. In a like manner, the opening 54 receives an anti-friction bearing 56 that supports the adjacent end of the transmission secondary shaft 52. It should be noted that both the primary and secondary shafts 51 and 52 extend slightly beyond the wall 47 for a reason to be described.

A plurality of gear sets and dog clutches 57 are carried by the primary shaft 51 within the cavity 46. These gear sets and dog clutches 57 are sized so that they may conveniently be assembled with the shaft 51 and inserted through the opening 48 upon assembly and may be removed through this opening for servicing. In a like manner, gear sets and dog clutches 58 are carried by the secondary shaft 52 and mesh with certain of the primary shaft gear sets 57. As is well known with this type of transmission, the respective gear sets 57 and/or 58 may be clutched to the respective shafts so as to afford desired change speed ratios to be achieved between the rotational speeds of the shafts 51 and 52 as well as a neutral condition.

A pair of driving and timing gears 59 are affixed to the exposed ends of the crankshafts 31 and 32 adjacent the gears 39. The gears 59 are in mesh with an input gear 61 that is journaled on the inner end of the transmission primary shaft 51. The gear 61 drives the input member of a clutch assembly 62 that is operated by means of a push rod 63 that extends through the hollow interior of the primary shaft 51 and is controlled by the operator in a known manner so as to selectively engage or disengage the clutch 62 so as to drive the primary shaft 51 under the operator control. The inner ends of the crankshafts 31 and 32, balancer shaft 42, clutch assembly 62 and the gears carried by the exposed ends of the shafts 51, 32, 31 and 42 are enclosed by means of a cover plate 64 that is affixed to the back face of the transmission crankcase casing 23 and cylinder block casing.

A kick starter mechanism including a kick starter shaft 65 is provided for kick starting of the engine. The kick starter shaft 65 is journaled in the rear wall 47 of the transmission portion of the casing 44 and in the cover plate 64. The exposed end of the shaft 65 carries a kick starter lever (not shown) for driving a kick starter mechanism 66 including a gear that is in mesh with a gear 67 journaled on the transmission secondary shaft 52. The gear 67, in turn, is in mesh with a gear 68 journaled on the primary shaft 51 which is, in turn, affixed for rotation with the transmission input gear 61. As a result, rotation of the kick starter shaft 65 will drive the crankshafts 31 and 32 for kick starting of the engine in a known manner.

The casing assembly for the engine transmission unit 19 further includes a cover plate 69 that is affixed to the face of the casing 23 through which the opening 48 extends and which serves to close this opening when assembled thereto. The cover plate 69 is formed with a first opening 71 in which a bearing 72 is positioned for journaling the adjacent end of the transmission secondary shaft 52. A suitable seal 73 is also positioned adjacent the bearing 72 so as to seal the interior of the transmission 49. In a like manner, a further opening 74 is formed parallel to the opening 71 and carries a bearing and seal assembly 75 for sealing the area around and rotatably journaling the transmission primary shaft 51. The exposed end of the secondary shaft 52 carries a sprocket 76 that is in driving engagement with a chain 77 for driving the motorcycle rear wheel 18 (FIG. 1).

Figure 5:
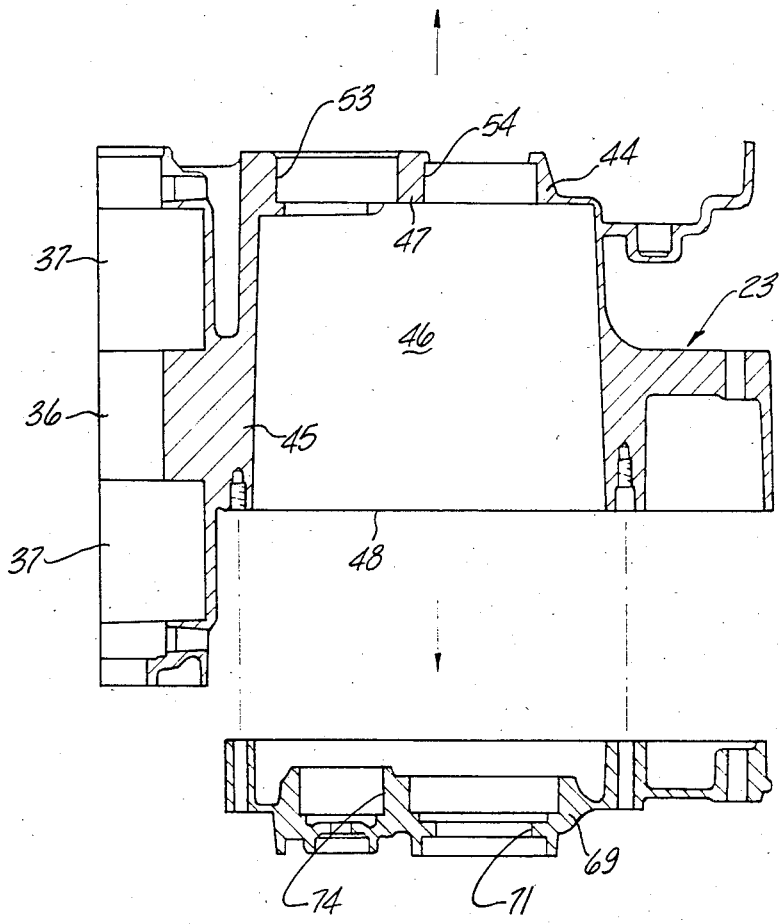
FIG. 5 is an exploded, cross-sectional view taken generally along the same plane as FIG. 3, and showing another embodiment.

FIG. 5 is an exploded view showing the manner in which the transmission case and cover plate 69 are assembled. The cover plate of this embodiment differs slightly from the previously described embodiment in the area where the primary and secondary shafts 51 and 52 pass through it. However, the principle of construction and operation is the same and, for that reason, further discussion of this embodiment is believed to be unnecessary.

It should be readily apparent from the foregoing description that the described casing assembly for the engine transmission 19 uses a minimum number of components and a minimum number of mating faces that must be sealed. However, by employing the cover plate 69 and the large opening 48, the transmission mechanism 49 may be conveniently assembly, disassembled and serviced without necessitating removal of a number of parts.

Although an embodiment of the invention has been illustrated and described, various changes and modifications may be made without departing from the spirit and scope of the invention, as defined by the appended claims. For example, although the invention has been described in conjunction with a V4 two-cycle type of internal combustion engine embodying parallel crankshafts, the invention is capable of use or certain facets of it are in conjunction with engines of other configurations and other types.

I claim:

1. A combined engine transmission case comprising a first casing forming a portion of the crank chamber of said engine, a second casing forming a transmission case and fixed relative to said first casing, an engine output shaft journaled within said crank chamber at an interface between said first and second casings for rotation about a first axis lying in a plane defined by said interface, said second casing being formed with an internal cavity sealed from said crank chamber and an opening in one side thereof facing in a direction parallel to said first axis, a transmission shaft insertable into said internal cavity through said opening, means for driving said transmission shaft from said engine output shaft, and a cover plate closing said second casing opening and at least in part journaling said transmission shaft for rotation about a second axis parallel to said first axis.

2. A combined engine transmission case as set forth in claim 1 wherein the first casing defines a pair of cylinder banks and there are a pair of engine output shafts journaled about respective first axes lying in a same plane and in the interface between the first and second casings.

3. A combined engine transmission case as set forth in claim 2 further including a balancer shaft driven by the engine output shafts for balancing reciprocating masses of the engine.

4. A combined engine transmission case as set forth in claim 3 wherein the balancer shaft rotates about an axis disposed in the same plane as the axes of rotation of the output shafts.

5. A combined engine transmission case as set forth in claim 1 wherein there are a pair of transmission shafts inserted into the internal cavity through the opening and the cover plate journals both of the transmission shafts.

6. A combined engine transmission case as set forth in claim 5 wherein the transmission shafts carry a plurality of interengaging change speed gears.

7. A combined engine transmission case as set forth in claim 6 wherein one of the transmission shafts comprises an input shaft and has an input gear driven by the engine output shaft.

8. A combined engine transmission case as set forth in claim 7 wherein the first casing defines a pair of cylinder banks and there are a pair of engine output shafts journaled about respective first axes lying in a same plane and in the interface between the first and second casings, each of said outputs shafts driving the input shaft.

9. A combined engine transmission case as set forth in claim 8 further including a balancer shaft driven by the engine output shafts for balancing reciprocating masses of the engine.

10. A combined engine transmission case as set forth in claim 9 wherein the balancer shaft rotates about an axis lying in the same plane as the axes of rotation of the output shafts.

11. A combined engine transmission case as set forth in claim 10 wherein the first and second casings define a plurality of crank chambers for containing the respective engine output shafts.

12. A combined engine transmission case as set forth in claim 1 wherein the means for driving the transmission shaft from the engine output shaft comprises drive means positioned externally of the crank chamber and the internal cavity of the second casing.

13. A combined engine transmission case as set forth in claim 5 wherein the means for driving the transmission shaft from the engine output shaft comprises drive means positioned externally of the crank chamber and the internal cavity of the second casing.

14. A combined engine transmission case as set forth in claim 11 wherein the means for driving the transmission shaft from the engine output shaft comprises drive means positioned externally of the crank chamber and the internal cavity of the second casing.

* * * * *